United States Patent [19]

Yeh

[11] Patent Number: 5,011,422

[45] Date of Patent: Apr. 30, 1991

[54] COAXIAL CABLE OUTPUT TERMINAL SAFETY PLUG DEVICE

[76] Inventor: Ming-Hwa Yeh, No. 2, Lane 8, Hsin An Rd., Shih Lin District, Taipei, Taiwan

[21] Appl. No.: 567,126

[22] Filed: Aug. 13, 1990

[51] Int. Cl.[5] ..... H01R 13/629; H01R 13/66

[52] U.S. Cl. ..... 439/307; 439/304; 439/620

[58] Field of Search ..... 439/304, 306, 307, 620; 338/216, 220

[56] References Cited

U.S. PATENT DOCUMENTS

| | | | |
|---|---|---|---|
| 3,890,028 | 6/1975 | Blanchenot | 338/220 X |
| 4,469,386 | 9/1984 | Ackerman | 439/304 X |
| 4,806,116 | 2/1989 | Ackerman | 439/304 |

*Primary Examiner*—Eugene F. Desmond

*Attorney, Agent, or Firm*—Asian Pacific Int'l Patent and Trademark Office

[57] ABSTRACT

A coaxial cable output terminal safety plug device, which comprises a driving tool to drive a plug to fastened in a coaxial cable output terminal which is not 5 in use. The plug comprises a round tube having received therein a threaded tube which has a resistor driven to insert in the signal output hole of a coaxial cable output terminal to match the impedance.

3 Claims, 3 Drawing Sheets

COAXIAL CABLE OUTPUT TERMINAL SAFETY PLUG DEVICE

BACKGROUND OF THE INVENTION

The present invention relates to a coaxial cable output terminal safety plug device for use in cable television systems (CATV), subscription television systems (STV) and master antenna TV systems (MATV) to releasably block up any signal output terminal which is not in use.

Regular cable television systems generally utilize coaxial cables to transmit audio signal to subscribers. Therefore, transformer of multiple output terminals and impedance matching and amplifying device must be used so that audio signal can be transmitted to each subscriber through coaxial cable. Because the number of subscribers is generally not equal to the number of output terminals, a plug which has an impedance matching device must be used to block up each output terminal which is not in use, so as to eliminate impedance matching problems between signal output coaxial cable and subscriber's coaxial cable.

The conventional plug which is used to block up a coaxial cable output terminal may be easily removed from an output terminal and a non-subscriber can easily connect an output terminal to a TV without paying any fee. Therefore, there is developed a kind of safety plug which requires a special tool to fastened in or remove from a coaxial cable signal output terminal and can effectively protect from piracy. However, this type of safety plug is expensive and easy to damage.

SUMMARY OF THE INVENTION

The present invention has been accomplished under the circumstances in view. It is the object of the present invention to provide a safety plug device for blocking up a coaxial cable signal output terminal, which is practical in use, simple in structure and inexpensive to manufacture.

According to the present invention, a safety plug comprises a plug and a driving tool. The plug comprises a round tube having concentrically set therein a threaded tube and a driving tube. The threaded tube has a resistor mounting tube at its rear end for holding a 75 ohm resistor. When the driving tool is inserted to drive the round tube to rotate, the two opposite, raised strips on the outer wall of the driving tube are engaged in the two opposite, longitudinal grooves on the inner wall of the round tube permitting the driving tube to follow the round tube to rotate. After the two toothed portions of the driving tube and the threaded tube are engaged together, the threaded tube is driven to be fastened in a coaxial cable signal output terminal permitting the resistor to insert in the signal output hole of the signal output terminal. If the driving too is not used, rotation of the round tube does not carry the threaded tube to rotate. Therefore, without the use of the driving tool, the plug can not be removed from a coaxial cable signal output terminal.

BRIEF DESCRIPTION OF THE DRAWINGS

The present invention will now be described by way of example, with reference to the annexed drawings, in which.

DETAILED DESCRIPTION OF THE PREFERRED EMBODIMENT

Figure 1:
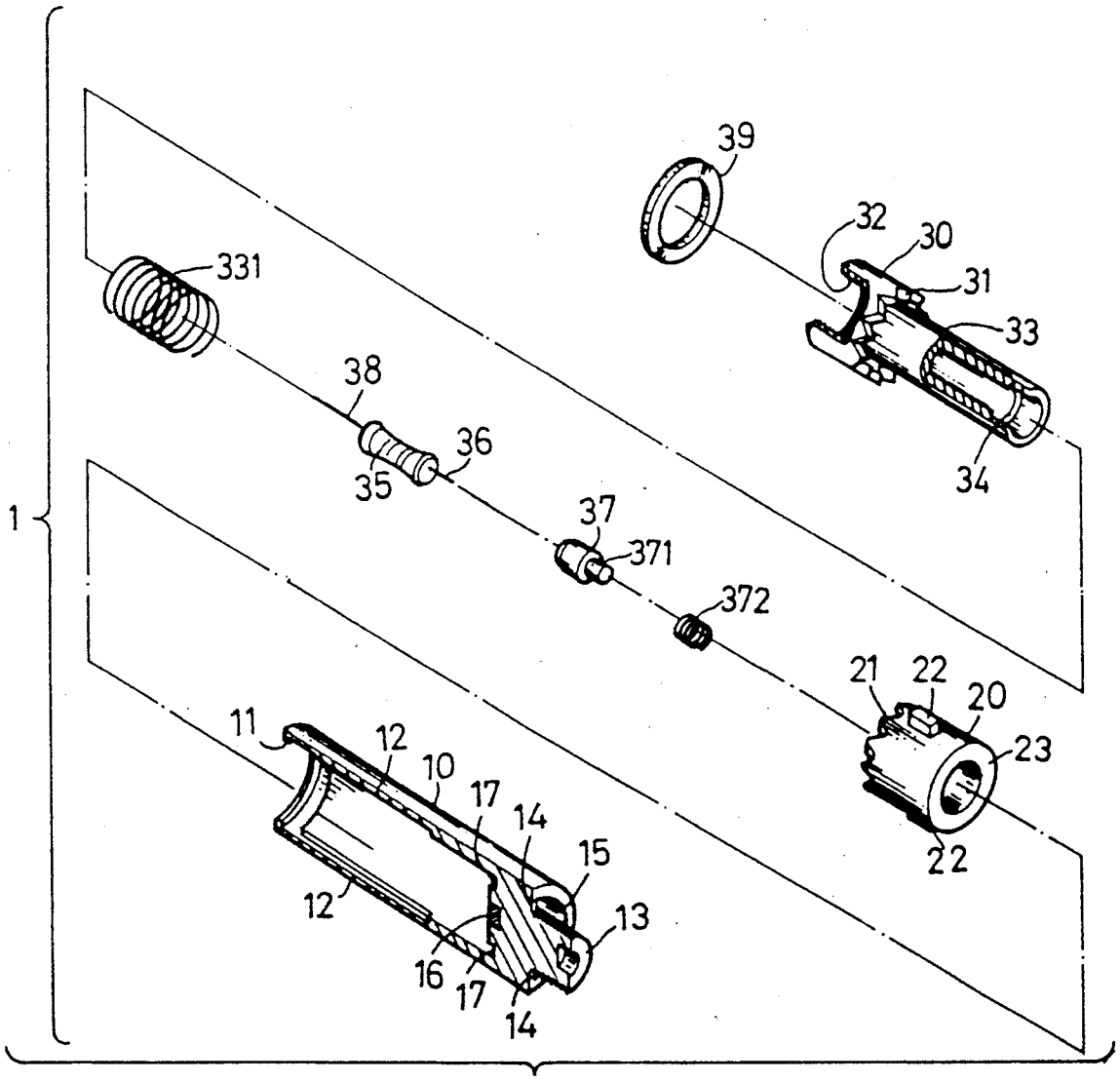
FIG. 1 is a perspective fragmentary view of a safety plug according to the present invention.
Figure 4:
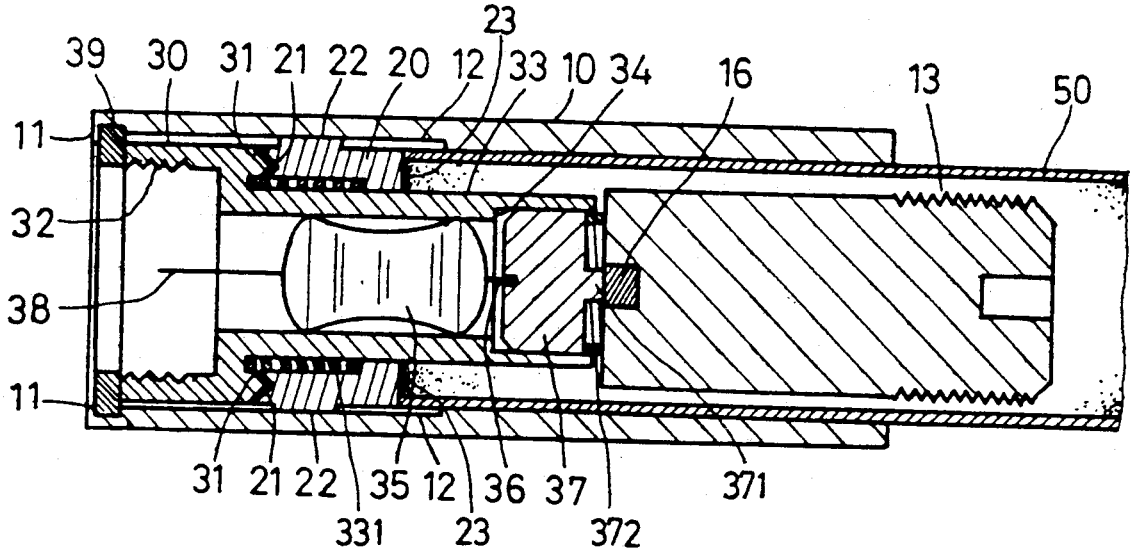
FIG. 4 is a sectional view, illustrating the insertion of the driving tool in the safety plug.

Turning now to the annexed drawings in greater detail and referring first to FIG. 1, therein illustrated is a coaxial cable output terminal safety plug device embodying the present invention and generally comprised of a safety plug 1 and a driving tool 5. A safety plug 1 of the present invention is generally comprised of a round tube 10 having an inner flange 11 at the front end, two opposite, longitudinal grooves 12 on the inner wall, and a cylindrical projection 13 at the rear end. The cylindrical projection 13 is designed in an outer diameter slightly smaller than the round tube 10. There are three stop strips 14 equidistantly connected between the round tube 10 and the cylindrical projection 13 and arranged in 120 degree angle of inclination, which define three sector channels 15 therebetween. A small copper strip 16 is internally fastened in the cylindrical projection 13 at its one end at the center.

There is a driving tube 20 and a threaded tube 30 concentrically received inside the round tube 10 between the inner flange 11 and the cylindrical projection 13. The driving tube 20 is concentrically disposed at the back of the threaded tube 30. The driving tube 20 has a toothed portion 21 at its front end and two opposite, raised strips 22 on its outer wall surface. The two opposite, raised strips 22 of the driving tube 20 are respectively engaged in the two longitudinal grooves 12 so that the round tube 10 can be driven by the driving tube 20 to rotate simultaneously.

The threaded tube 30 has a toothed portion 31 at its rear end and engaged with the toothed portion 21 of the driving tube 20, an inner thread 32 at its front end for screwing up with the outer thread 60 of an coaxial cable output terminal 6. A resistor mounting tube 33 extends from the rear end of the threaded tube 30 and inserted through the driving tube. A compression spring 331 is sleeved on the resistor mounting tube 33 and set between the threaded tube 30 and the driving tube 20 to constantly push the driving tube 20 and the threaded tube 30 apart. When a sufficient axial force is applied on the driving tube 20 to compress the compression spring 331, the two toothed portions 21 and 31 are forced to engage together so that the driving tube 20 and the threaded tube 30 can be driven to move together. The resistor mounting tube 33 has a stepped portion 34 in larger inner diameter. There is a 75 ohms ½ watt resistor 35 fastened inside the resistor mounting tube 33. The resistor 35 has a rear end conductor 36 fixedly connected to an element 37, which has a projecting end 371 sleeved with a spring 372 and stopped against the copper strip 16 of the cylindrical projection 13, and a front end conductor 38 extending out of the front end of the resistor mounting tube 33. When the threaded tube 30 is fastened to the outer thread 60 of a coaxial cable output terminal 6, the rear end conductor 38 is inserted in the signal output hole 61 of such a coaxial cable output terminal 6, and the spring 372 gives a force to push the resistor mounting tube 33 and the threaded tube 30 forward permitting the driving tool 5 to be conveniently inserted in the round tube 10 for operation.

In manufacturing process, component parts are inserted in the round tube 10 with a rubber ring 39 mounted on the front end of the threaded tube 30 to protect the outer wall surface of the threaded tube 30 from damage. After insertion of all component parts, the round tube 10 is hit at its front end to form the inner flange 11 so as to firmly retain all the component parts inside the round tube.

The driving tool 5 comprises a handle 51 having a front tube 50 extending therefrom and designed in size between the inner diameter of the round tube 10 and the outer diameter of the resistor mounting tube 33. The front tube 50 has three longitudinal channels 52 made at the front and defining therewith three semi-circular strips 53 which are permitted to respectively insert through the three sector channels 15 into the inner space of the round tube 10. There are also three openings 54 radially made on the front tube 50 around a circle near the front end of the front tube 50.

Figure 2:
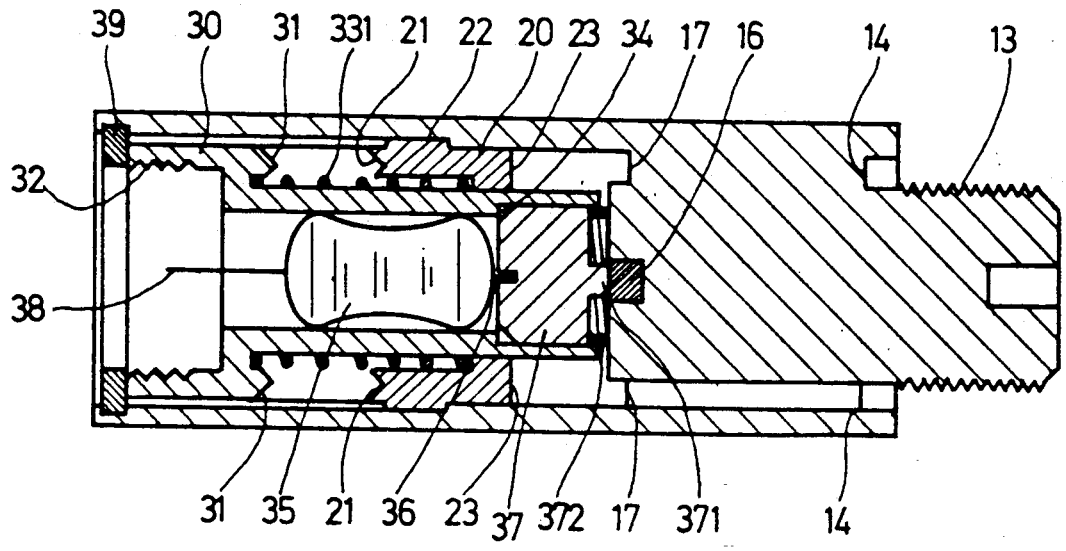
FIG. 2 is a sectional view of the safety plug thereof.
Figure 3:
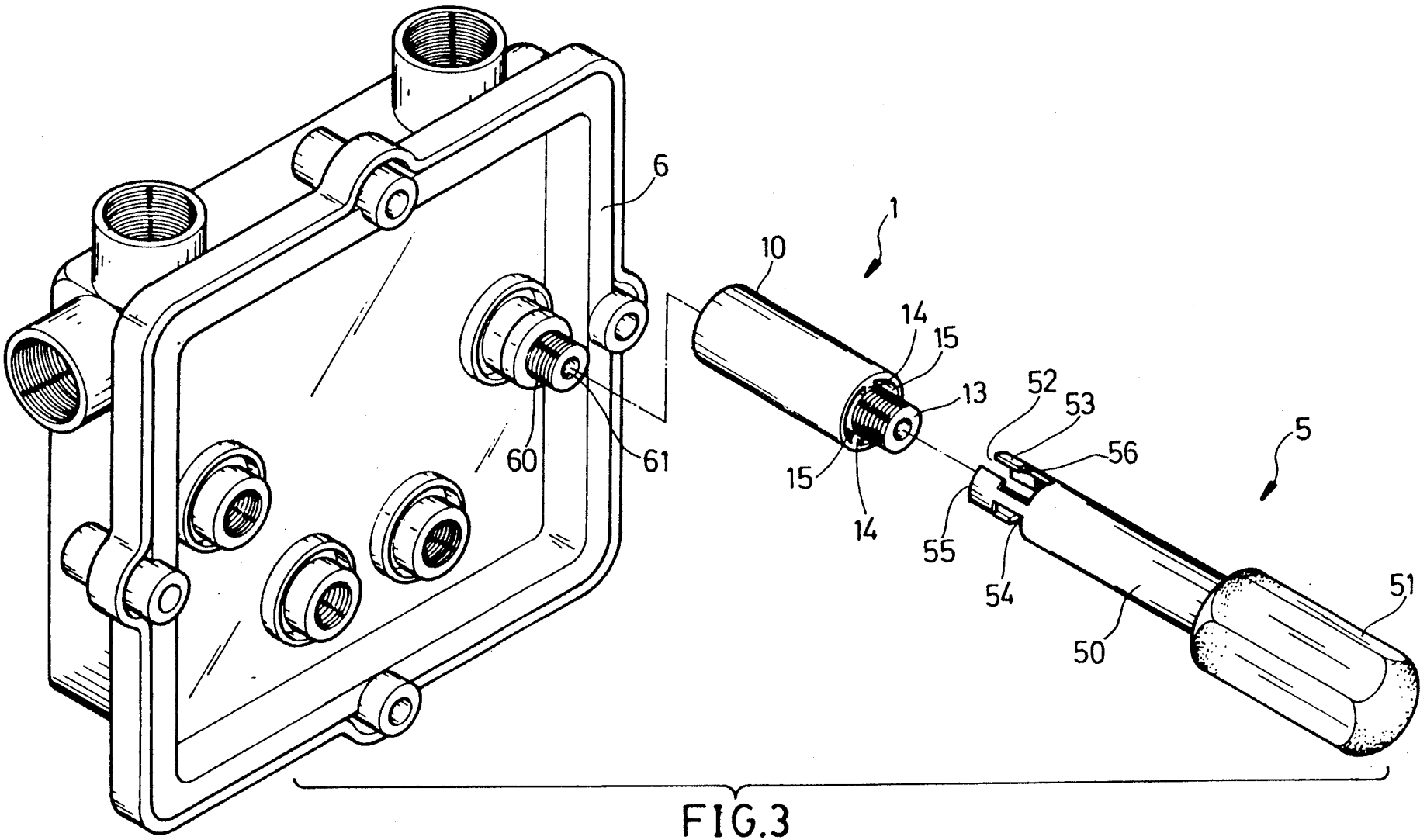
FIG. 3 is a perspective schematic drawing, illustrating the operation of a driving tool of the present invention in fastening a safety plug of the present invention in a coaxial cable output terminal.

The operation of the driving tool 5 is outlined hereinafter. After the driving tool 5 is inserted in the round tube 10 with its front end stopped against the rear end 23 of the driving tube 20, it is rotated to permit the stop strips 14 enter the openings 54. The range between the front ends 56 of the openings 54 and the front end 55 of the front tube 50 is strictly controlled to be slightly shorter than the range between the front ends 17 of the stop strips 14 and the rear end 23 of the driving tube 20 such that the front tube 50 of the driving tool 5 can be moved to push the two toothed portions 21 of the driving tube 20 to firmly engage with the toothed portion 31 of the threaded tube 30. After the raised strips 22 are fastened in the longitudinal grooves 12 and the two toothed portions 21 are engaged together, the driving tool 5 is rotated to carry the driving tube 20 and the threaded tube 30 to rotate together so as to drive the threaded tube 30 to be fastened up with the outer thread of a coaxial cable output terminal 6 permitting the front conductor 38 of the resistor 35 to insert in the signal output hole 61 of such a terminal 6 (see FIG. 3). If the two toothed portions 21 and 31 are not engaged together, rotation of the driving tool will drive the round tube 10 to make idle rotation, and therefore, the threaded tube 30 will be not driven to disengage from the outer thread 60 of such a coaxial cable output terminal (see FIG. 2).

The foregoing drawings and description are for the purpose of illustration only. Recognizing that various modifications will be been apparent, the scope herein shall be deemed as defined in the claims as set forth hereinafter.

What is claimed is:

1. A coaxial cable output terminal safety plug device comprising:

a plug comprising a round tube having an inner flange at the front end, two opposite, longitudinal grooves on the inner wall, and a cylindrical projection at the rear end, said cylindrical projection being designed in an outer diameter slightly smaller than said round tube and having three stop strips equidistantly connected between said round tube and said cylindrical projection, a driving tube and a threaded tube concentrically received therein, said driving tube having toothed portion at its front end and two opposite, raised strips on its outer wall surface respectively releasably engaged in said two longitudinal grooves, said threaded tube having a toothed portion at its rear end and releasably engaged with the threaded portion of said driving tube and an inner thread at its front end, a resistor mounting tube extending from the rear end of said threaded tube inserted in said driving tube for holding a resistor therein, a compression spring sleeved on said resistor mounting tube and set between said threaded tube and said driving tube, said resistor mounting tube having a stepped portion in larger inner diameter, said resistor having a rear end conductor fixedly connected to an element, said element having a projecting end sleeved with a spring and stopped between said element and the front end of said cylindrical projection; and a driving tool comprising a handle having a front tube extending therefrom, said front tube having three longitudinal channels made at the front and three openings radially made on its periphery around a circle near the front end thereof.

2. The coaxial cable output terminal safety plug device according to claim 1, wherein the range between the front ends of said openings and the front end of said front tube is slightly shorter than the range between the front ends of said stop strips and the rear end of said driving tube.

3. The coaxial cable output terminal safety plug device according to claim 1, wherein the range between the front ends of said openings and the front end of said front tube of said driving tool is designed to permit said driving tube to be axially moved to drive its toothed portion to engage with the toothed portion of said threaded tube.

* * * * *